US009068441B2

(12) United States Patent
Sampson

(10) Patent No.: US 9,068,441 B2
(45) Date of Patent: Jun. 30, 2015

(54) PERFORATING STIMULATING BULLET

(75) Inventor: Timothy Sampson, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 547 days.

(21) Appl. No.: 13/225,006

(22) Filed: Sep. 2, 2011

(65) Prior Publication Data

US 2013/0056212 A1 Mar. 7, 2013

(51) Int. Cl.

| | |
|---|---|
| ***E21B 43/26*** | (2006.01) |
| ***E21B 43/116*** | (2006.01) |
| ***F42B 5/03*** | (2006.01) |
| ***F42B 12/08*** | (2006.01) |
| ***F42B 12/20*** | (2006.01) |
| ***F42B 12/36*** | (2006.01) |
| ***F42B 5/045*** | (2006.01) |
| ***F42B 5/08*** | (2006.01) |
| ***F24D 3/00*** | (2006.01) |
| ***F41C 9/08*** | (2006.01) |

(52) U.S. Cl.

CPC ..... *E21B 43/116* (2013.01); *F42B 5/03* (2013.01); *F42B 12/08* (2013.01); *F42B 12/20* (2013.01); *F42B 12/36* (2013.01); *F42B 5/045* (2013.01); *F42B 5/08* (2013.01); *F24D 3/00* (2013.01); *F41C 9/08* (2013.01)

(58) Field of Classification Search

CPC . E21B 43/116; E21B 43/1185; E21B 43/117; E21B 7/007; E21B 43/263; E21B 29/02

See application file for complete search history.

(56) References Cited

U.S. PATENT DOCUMENTS

| | | | | |
|---|---|---|---|---|
| 2,362,738 | A * | 11/1944 | Yarbrough | 175/4.57 |
| 2,462,784 | A | 2/1949 | Smith | |
| 3,209,650 | A * | 10/1965 | Andrew | 175/3.5 |
| 3,419,089 | A * | 12/1968 | Venghiattis | 175/4.57 |
| 4,216,722 | A * | 8/1980 | Angell | 102/491 |
| 4,969,525 | A | 11/1990 | George et al. | |
| 5,035,183 | A * | 7/1991 | Luxton | 102/502 |
| 5,078,210 | A | 1/1992 | George | |
| 5,224,545 | A | 7/1993 | George et al. | |
| 5,287,924 | A | 2/1994 | Burleson et al. | |
| 5,355,957 | A | 10/1994 | Burleson et al. | |
| 5,386,780 | A | 2/1995 | Klein | |
| 5,551,344 | A | 9/1996 | Couet et al. | |
| 5,652,408 | A * | 7/1997 | Nicolas | 102/499 |
| 6,095,245 | A | 8/2000 | Mount | |
| 6,925,924 | B2 | 8/2005 | Baker et al. | |
| 7,296,625 | B2 | 11/2007 | East, Jr. | |
| 7,350,448 | B2 | 4/2008 | Bell et al. | |

(Continued)

OTHER PUBLICATIONS

International Search Report and Written Opinion of the International Searching Authority; Dated May 29, 2013, International Application No. PCT/US2012/052833, International Filing Date: Aug. 29, 2012.

(Continued)

*Primary Examiner* — Jennifer H Gay
*Assistant Examiner* — Caroline Butcher
(74) *Attorney, Agent, or Firm* — Bracewell & Giuliani LLP

(57) ABSTRACT

A method and device for fracturing a subterranean formation by projecting a bullet assembly into the formation and then reacting energetic material within the bullet assembly. The bullet assembly can be part of a charge device that is in a perforating gun. A delay fuse can be included so the energetic material reaction begins after the bullet assembly reaches the end of its travel in the formation.

14 Claims, 3 Drawing Sheets

(56) References Cited

U.S. PATENT DOCUMENTS

| | | | | |
|---|---|---|---|---|
| 7,721,650 | B2 | 5/2010 | Barton et al. | |
| 7,819,064 | B2 | 10/2010 | Saenger et al. | |
| 2002/0189482 | A1* | 12/2002 | Kneisl et al. | 102/306 |
| 2005/0115448 | A1 | 6/2005 | Pratt et al. | |
| 2008/0034951 | A1 | 2/2008 | Evans et al. | |
| 2008/0035007 | A1* | 2/2008 | Nielson et al. | 102/517 |
| 2008/0099204 | A1 | 5/2008 | Arrell | |
| 2008/0105430 | A1 | 5/2008 | Cuthill | |
| 2008/0110612 | A1 | 5/2008 | Prinz | |
| 2009/0078420 | A1* | 3/2009 | Caminari et al. | 166/297 |
| 2009/0193995 | A1* | 8/2009 | Bohnet et al. | 102/501 |
| 2010/0000789 | A1 | 1/2010 | Barton | |
| 2010/0051278 | A1 | 3/2010 | Mytopher et al. | |
| 2011/0139505 | A1 | 6/2011 | Huang et al. | |

OTHER PUBLICATIONS

Halliburton, article titled "Perforating Solution," found at www.haliburton.com/public/Ip/contents/Books_and_Catalogs/web/TCPCatalog/2005TCPCatalog/Perforating_Solutions_2005.html, published/issue date May 2006.

Halliburton, article titled Extended Delay and Modular Delay Fuses, found at www.halliburton.com/ps/default.aspx?, 2011.

PCT International Preliminary Report on Patentability mailed Mar. 13, 2014.

* cited by examiner

PERFORATING STIMULATING BULLET

BACKGROUND

1. Field of Invention

The invention relates generally to a device for perforating a wellbore. More specifically, the present invention relates to a charge device having a perforating bullet equipped with energetic material.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

Perforating systems typically include one or more perforating guns connected together in series to form a perforating gun string, which can sometimes surpass a thousand feet of perforating length. The gun strings are usually lowered into a wellbore on a wireline, where the individual perforating guns are generally coupled together by connector subs. Often, a surface truck accompanies the perforating systems that connects to an upper end of the wireline. In addition to being used for raising and lowering the gun string, the wireline typically is used as a communication means and control signal path between the truck and the perforating string. The wireline is generally threaded through pulleys supported above the wellbore. Derricks, slips and other similar systems may sometimes be used in lieu of a surface truck for inserting and retrieving the perforating system into and from a wellbore. Also, tubing, drill pipe, slick line, and/or coiled tubing are alternatives to wireline for disposing perforating systems into a wellbore.

SUMMARY OF THE INVENTION

Disclosed herein is are examples of a device and method for fracturing a subterranean formation. A charge device for use in fracturing a formation adjacent a wellbore is described, that in one example embodiment includes a housing with an explosive. Also included is a bullet assembly provided in the housing made up of a jacket with forward and rearward ends. An energetic material is within the jacket along with a delay fuse in selective communication with the energetic material. A detonation wave is formed that directs the bullet assembly into the formation when the explosive in the housing is detonated. A reaction of the energetic material is initiated by the delay fuse when the bullet assembly is in the formation to form a fracture in the formation. In an example embodiment, the jacket is formed from an energetic material. Optionally, the delay fuse can be ignited by communication with the explosive. A seal ring may be included that circumscribes the jacket. In an alternate embodiment, a perforation forms in the formation when the bullet assembly is projected into the formation and the seal ring provides a pressure barrier between the bullet assembly and an inner surface of the perforation. The forward end of the bullet assembly can be frangible, so that when expanding gases are produced by initiating the energetic material, pressure from the expanding gases is directed into the formation through the forward end. In an example embodiment, the energetic material may be a substance such as an oxidizing agent, a propellant, or combinations thereof.

Also included herein is a method of fracturing a subterranean formation that in one example includes providing a bullet assembly having a jacket, an energetic material, and a delay fuse. The bullet assembly is disposed in a wellbore and then launched from the wellbore and a distance into the formation. This produces a perforation in the formation. The energetic material is reacted after the bullet assembly is launched a distance into the wellbore. Reacting the energetic material generates pressure within the formation to fracture the formation. In an example embodiment, the bullet assembly is part of a charge device that is set within a perforating gun. Optionally, an end of the delay fuse is exposed to a detonation wave so that the delay fuse transfers the detonation wave to the energetic material for reacting the energetic material. In an example embodiment, the energetic material is a substance such as an oxidizing agent, a propellant, high explosive, or combinations thereof. Alternatively, a force generated by the bullet assembly impacting the formation is transferred into the bullet assembly for reacting the energetic material. The method may optionally further include sealing between the bullet assembly and the perforation. Optionally, the energetic material is reacted when the bullet assembly reaches an end of the perforation.

BRIEF DESCRIPTION OF DRAWINGS

Some of the features and benefits of the present invention having been stated, others will become apparent as the description proceeds when taken in conjunction with the accompanying drawings, in which.

Figure 1:
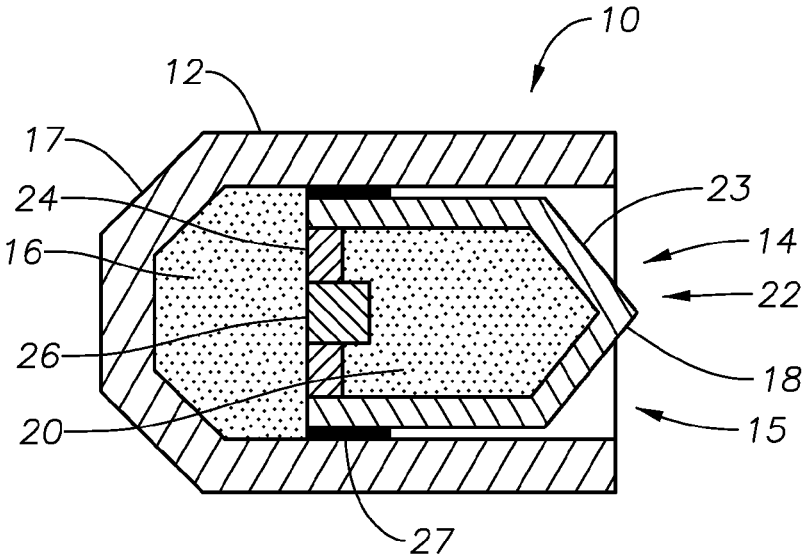
FIG. 1 is a side sectional view of an example embodiment of a charge device that includes a perforating bullet in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

FIG. 1 is a side sectional view of an example embodiment of a charge device 10 that includes a housing 12 containing a bullet assembly 14. Housing 12 has an generally annular portion with an opening 15 on one end. Explosive 16 is shown set within the housing 12 and adjacent a closed end 17 provided opposite the opening 15. The bullet assembly 14 is coaxially disposed within the housing 12 and set against the explosive 16. Examples of the explosive 16 include HMX, RDX, PYX, HNS, other explosives, and high explosives used in perforating subterranean formations.

The bullet assembly 14 of FIG. 1 is covered by a jacket 18 in which is contained an amount of energetic material 20. Examples of energetic material include oxidizing agents, peroxides, propellants, and combinations thereof. A front end 22 of the bullet assembly 14 is shown having a generally conical shape that faces the opening 15 of the housing 12. Optionally, one or more scores 23 may be provided on the front end 22. A rear wall 24 is shown on an end of the bullet assembly 14 distal from the front end 22 and adjacent the explosive 16. The rear wall 24 includes a passage therethrough that extends substantially axially with the charge device 10 and in which a delay fuse 26 is inserted. Optionally, a seal ring 27 may be included with the bullet assembly 14 shown circumscribing the jacket 18. In the embodiment of FIG. 1 the seal ring 27 is proximate the rear wall 26.

Figure 2:
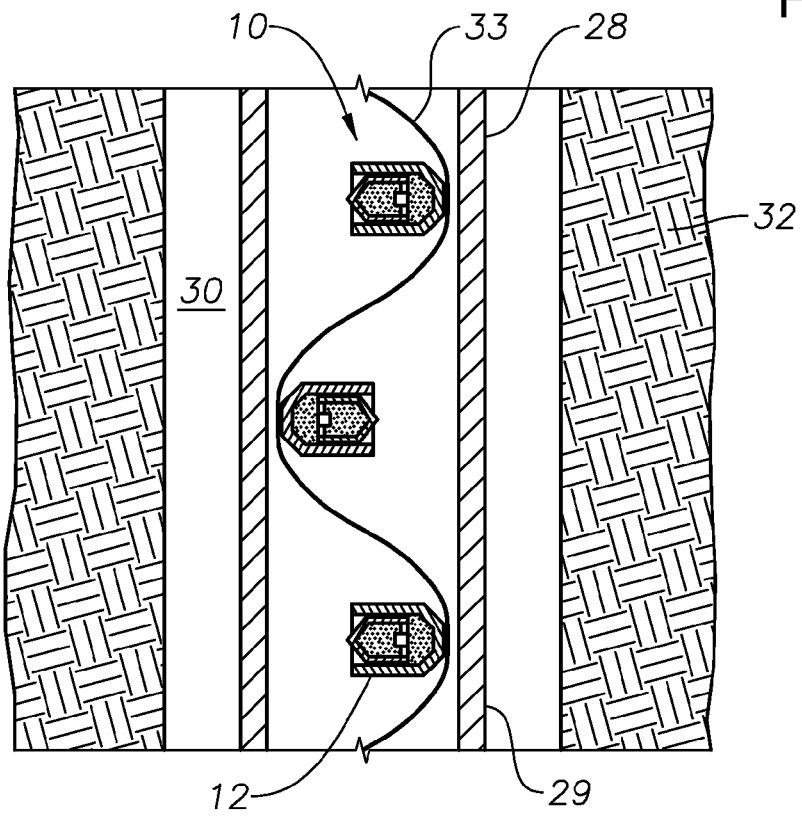
FIG. 2 is a side sectional view of a portion of a perforating gun having an embodiment of the charge device of FIG. 1 in accordance with the present invention.

FIG. 2 illustrates an embodiment of a wellbore gun 28 that includes a generally annular gun body 29 in which examples of charge devices 10 are disposed. In the example of FIG. 2, the charge devices 10 are positioned so that the openings 15 of the housings 12 are facing in a generally radial direction within the gun body 29. The wellbore gun 28 is deployed axially within a wellbore 30 shown intersecting a subterranean formation 32. A detonation cord 33 is included with the wellbore gun 28 connecting to each of the charge devices 10.

Figure 3:
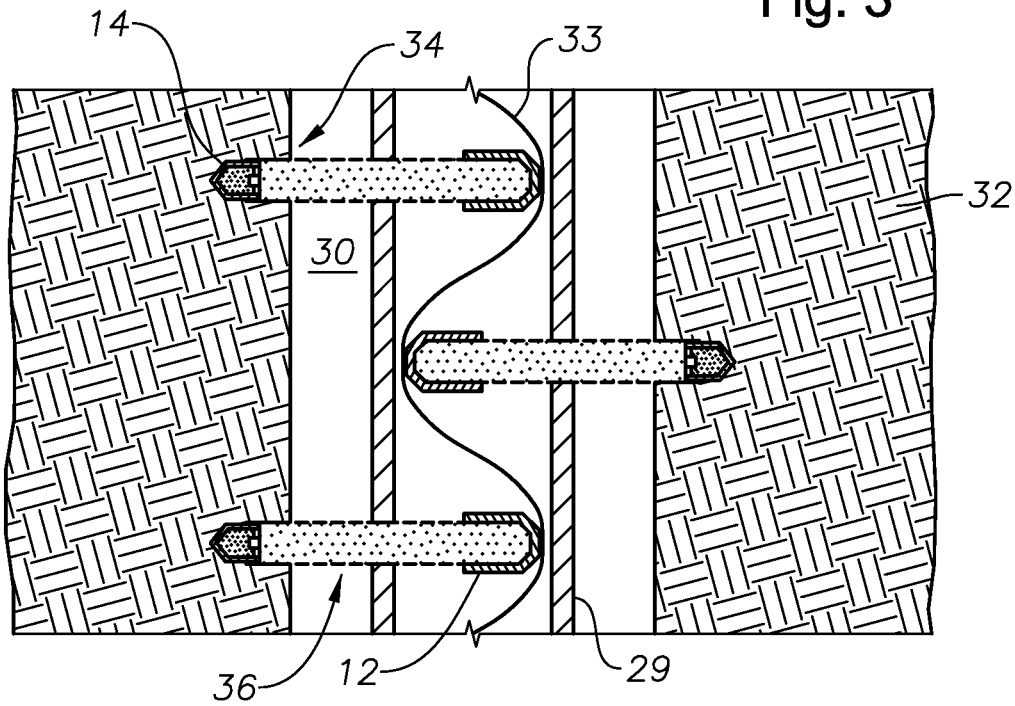
FIGS. 3-5 are side sectional views of an example sequence of operation of the portion of a perforating gun of FIG. 2 in accordance with the present invention.
Figure 4:
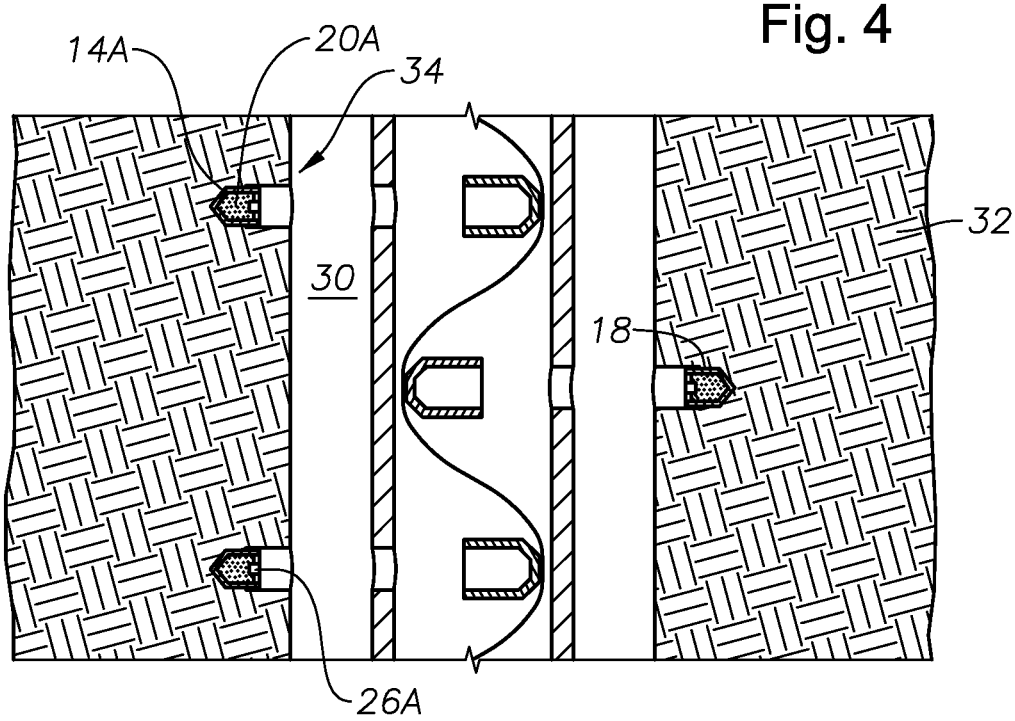
Figure 5:
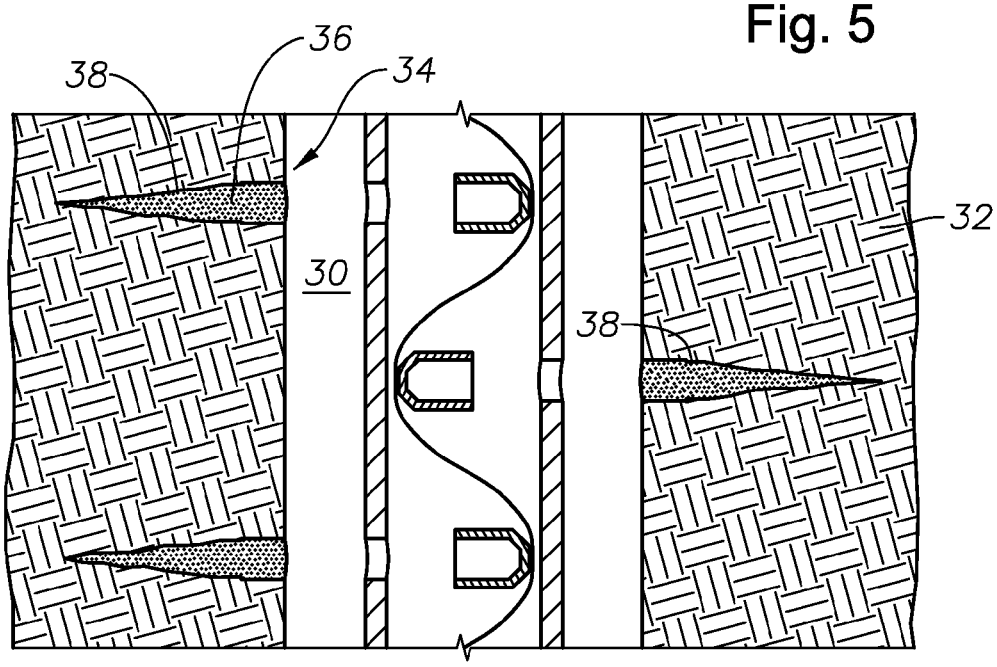

FIGS. 3 through 5 are side sectional views of an example of operation of the wellbore gun 28 within the wellbore 30. More specifically, with reference to FIG. 3, a detonation wave (not shown) has been initiated within the detonating cord 33 that in turn initiates detonation of the explosive 16 set within each of the charge devices 10. The detonating explosive 16 propels the bullet assemblies 14 from within the housing 12 out through the gun body 29 and a distance into the formation 32, thereby creating perforations 34 within the formation 32. A trail of combustion gases 36 is shown spanning from within the housing 12 and into the perforations 34. Subsequently, and as shown in sectional view in FIG. 4, the energetic material 20A within the bullet assemblies 14A begins to react within the respective jackets 18 of the bullet assemblies 14A. The reaction of the energetic material 20A can be initiated by the detonation fuse 26A. In one example, the fuse 26A has an outer end initiated through communication with the combustion gases 36. The time of travel of the detonation wave through the delay fuse 26A is of sufficient duration to allow the bullet assembly 14A to reach a distance within the formation 32 before initiating reaction of the energetic material 20A.

Referring now to FIG. 5, pressure generated by the reacting energetic material has exceeded the yield point of the material making up the jacket 18 thereby fracturing the jacket 18 and exposing the formation 32 to pressure generated by the reacting energetic material. Sufficient pressure generation by the reacting energetic material applied in the perforations 34 produces fractures 38 shown propagating through the formation 32 from the terminal ends of the perforations 34. The optional scores 23 on the bullet assemblies 14 ease fracturing of the jackets 18 thereby subjecting the formation 32 to the pressure from the energetic material to produce the fractures 38. Moreover, the optional seal ring 27 may create a pressure barrier between the bullet assembly 14 and inner surface of the perforations 34 so that the force from the generated pressure is directed into the formation 32 rather than escaping back into the wellbore 30.

Figure 6:
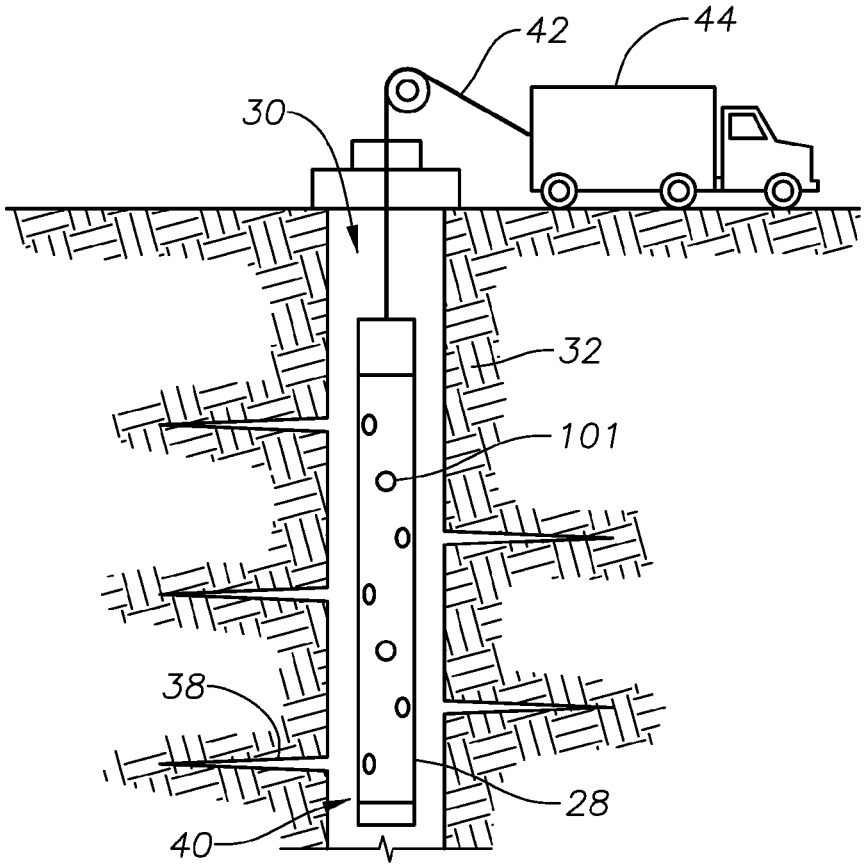
FIG. 6 is a side view of an example embodiment of perforating a wellbore in accordance with the present invention.

One example of a fracturing operation as shown in partial sectional view in FIG. 6, a perforating string 40 is shown disposed in the wellbore 30, wherein the perforating string 40 is made up of multiple downhole guns 28 stacked in series. The perforating string 40 is shown suspended on wire line 42 that is controlled via a surface truck 44. The string of wellbore guns 28 may then be used to create a series of fractures 38 disposed at axial distances within the formation 32.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A charge device for use in fracturing formation adjacent a wellbore comprising:

a housing;

an explosive in the housing; and a bullet assembly in the housing comprising a jacket having a forward end, a rearward end, and sidewalls between the forward end and rearward end that define a cavity within, energetic material disposed in the cavity and energetic energy that is disposed within material of the jacket, and a delay fuse in selective communication with the energetic material, so that a detonation wave forms and directs the bullet assembly into the formation when the explosive in the housing is detonated and a reaction of the energetic material is initiated by the delay fuse when the bullet assembly is in the formation to form a fracture in the formation.

2. The charge device of claim 1, wherein energetic material is housed in the jacket with the explosive, and wherein the energetic material is selected from the group consisting of a propellant, an oxidizer, and combinations thereof.

3. The charge device of claim 1, wherein the delay fuse is ignited by communication with the explosive.

4. The charge device of claim 1, further comprising a seal ring that seals an annular space between the jacket and housing.

5. The charge device of claim 4, wherein a perforation is formed into the formation when the bullet assembly is projected into the formation and the seal ring provides a pressure barrier between the bullet assembly and an inner surface of the perforation.

6. The charge device of claim 1, wherein the forward end comprises an outer surface with a score so that the forward end is frangible, and so that when expanding gases are produced by initiating the energetic material, pressure from the expanding gases fractures the forward end and is directed into the formation through the forward end.

7. The charge device of claim 1, wherein the energetic material comprises a substance selected from the group consisting of an oxidizing agent, a propellant, and combinations thereof.

8. The charge device of claim 1, further comprising a rear wall disposed in an opening in the rearward end of the jacket, wherein the rear wall separates the explosive from the energetic material in the cavity.

9. A method of fracturing a subterranean formation comprising:

a. providing a bullet assembly comprising a jacket made from a material that comprises an energetic material, a cavity in the jacket, energetic material in the cavity, and a delay fuse;

b. disposing the bullet assembly in a wellbore;

c. detonating an explosive to launch the bullet assembly from the wellbore a distance into the formation thereby producing a perforation in the formation; and d. reacting the energetic material after the bullet assembly is launched a distance into the wellbore to generate pressure within the formation to generate an elongated fracture in the formation that extends past an end of the perforation.

10. The method of claim 9, wherein the bullet assembly is part of a charge device that is set within a perforating gun.

11. The method of claim 9, wherein the energetic material comprises a substance selected from the group consisting of an oxidizing agent, a propellant, high explosives, and combinations thereof.

12. The method of claim 9, wherein a force generated by the bullet assembly impacting the formation is transferred into the bullet assembly for reacting the energetic material.

13. The method of claim 9, further comprising sealing between the bullet assembly and the perforation.

14. The method of claim 9, wherein the energetic material is reacted when the bullet assembly reaches an end of the perforation.

* * * * *